US008648033B2

(12) United States Patent
Gaudin

(10) Patent No.: US 8,648,033 B2
(45) Date of Patent: Feb. 11, 2014

(54) ORGANIC CARBONATES WITH VANILLA ODOR

(75) Inventor: Jean-Marc Gaudin, Shanghai (CN)

(73) Assignee: Firmenich SA, Geneva (CH)

( * ) Notice: Subject to any disclaimer, the term of this patent is extended or adjusted under 35 U.S.C. 154(b) by 0 days.

(21) Appl. No.: 13/635,131

(22) PCT Filed: Apr. 4, 2011

(86) PCT No.: PCT/IB2011/051427

§ 371 (c)(1),
(2), (4) Date: Sep. 14, 2012

(87) PCT Pub. No.: WO2011/132098

PCT Pub. Date: Oct. 27, 2011

(65) Prior Publication Data

US 2013/0011352 A1 Jan. 10, 2013

Related U.S. Application Data

(60) Provisional application No. 61/326,327, filed on Apr. 21, 2010.

(30) Foreign Application Priority Data

Apr. 21, 2010 (EP) ..... 10160575

(51) Int. Cl.
*A61Q 13/00* (2006.01)

(52) U.S. Cl.
USPC ..... 512/21

(58) Field of Classification Search
None
See application file for complete search history.

(56) References Cited

U.S. PATENT DOCUMENTS

| | | | | |
|---|---|---|---|---|
| 4,464,280 | A | 8/1984 | Boden et al. | 252/174.11 |
| 4,650,604 | A | 3/1987 | Broekhof et al. | 252/522 |
| 6,306,818 | B1 * | 10/2001 | Anderson et al. | 512/2 |
| 2007/0105749 | A1 * | 5/2007 | Gaudin | 512/25 |

FOREIGN PATENT DOCUMENTS

| | | | |
|---|---|---|---|
| DE | 198 02 198 | A1 | 7/1999 |
| DE | 10227734 | A1 * | 1/2004 |
| EP | 0 179 532 | A1 | 4/1986 |
| JP | 2001-106655 | A | 4/2001 |

OTHER PUBLICATIONS

English Translation of DE 102 27 734 A1.*
International Search Report and Written Opinion, application No. PCT/IB2011/051427, mailed May 25, 2011.
Challis et al., "339. Homovanillin," J. Chem. Soc., 1692-1699 (1947).
Scarpati et al., "Selective Formylation of Diphenols," Synthetic Communications, 20(17): 2565-2572 (1990).

* cited by examiner

*Primary Examiner* — Kevin S Orwig
*Assistant Examiner* — Dominic Lazaro
(74) *Attorney, Agent, or Firm* — Winston & Strawn LLP

(57) ABSTRACT

The invention relates to a method to confer, enhance, improve or modify the odor properties of a perfuming composition or of a perfumed article, by adding to the composition or article an effective amount of at least a compound of formula (I)

(I)

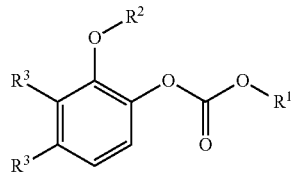

wherein $R^1$ represents a $C_{1-3}$ hydrocarbon group;

$R^2$ represents a $C_{1-3}$ hydrocarbon group; and one $R^3$ represents a $C_{1-3}$ hydrocarbon group, and the other $R^3$ represents a hydrogen atom. The invention also relates to perfuming compositions and perfuming consumer products containing these compounds.

9 Claims, No Drawings

ORGANIC CARBONATES WITH VANILLA ODOR

This application is a 371 filing of International Patent Application PCT/IB2011/051427, filed Apr. 4, 2011, and claims the benefit of U.S. provisional application no. 61/326,327 filed Apr. 21, 2010.

TECHNICAL FIELD

The present invention relates to the field of perfumery. More particularly, it concerns some alkyl aryl carbonates as perfuming ingredients to impart spicy and/or balsamic notes. The present invention concerns the use of said compounds in the perfumery industry as well as the compositions or articles containing said compounds.

PRIOR ART

The world of perfumery is always looking for new interesting ingredients providing spicy, balsamic odors, in particular of the vanilla type. Furthermore, if such new ingredients do not have the drawback problem of coloring upon aging (like vanillin), it is all the more interesting.

Some of the invention's compounds have been reported in the literature. However, to the best of our knowledge, for none of them it has been reported or suggested any organoleptic properties, and even less any use of said compounds as perfuming ingredients.

For instance, 2-methoxy-4-methylphenyl methyl carbonate has been reported by Scarpati et al. (in *Synthetic Communication,* 20, 2565, 1990) as simple chemical starting material. Furthermore, 2-methoxy-4-(prop-2-enyl)ethyl carbonate has been reported by Challis et al. (in *J. Chem. Soc,* 1692, 1947) as simple chemical starting material. However, this prior art document does not report or suggest any organoleptic properties of the compounds of formula (I), or any use of said compounds in the field of perfumery.

DESCRIPTION OF THE INVENTION

We have now surprisingly discovered that a compound of formula (I)

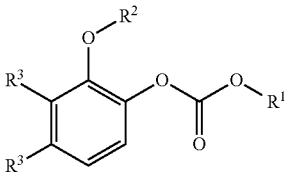

wherein $R^1$ represents a $C_{1-3}$ hydrocarbon group;

$R^2$ represents a $C_{1-3}$ hydrocarbon group; and one $R^3$ represents a $C_{1-3}$ hydrocarbon group, and the other $R^3$ represents a hydrogen atom;

can be used as perfuming ingredient, for instance to impart odor notes of the spicy and/or balsamic type.

According to a particular embodiment of the invention, said compound (I) is of formula (II)

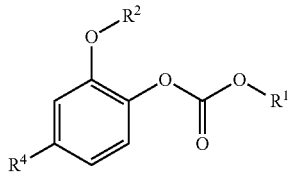

wherein $R^1$ and $R^2$ have the meaning indicated above, and $R^4$ represents a $C_{1-3}$ hydrocarbon group.

According to a particular aspect of any one of the above embodiments of the invention, said hydrocarbon groups are alkyl groups.

According to a particular aspect of any one of the above embodiments of the invention, $R^1$ may represent a methyl or ethyl group, and in particular a methyl group.

According to a particular aspect of any one of the above embodiments of the invention, $R^2$ may represent a methyl or ethyl group, and in particular a methyl group.

According to a particular aspect of any one of the above embodiments of the invention, $R^3$ or $R^4$ may represent a methyl, ethyl or n-propyl group, and in particular a methyl or n-propyl group.

According to any one of the above embodiments of the invention, said compound is a $C_{10}$-$C_{12}$ compound.

As specific examples of the invention's compounds, one may cite, as non-limiting example, 2-methoxy-4-methyl-phenyl methyl carbonate. Said compound has an odor of the sweet vanilla (balsamic) type, very close to, and reminding of the odor of vanillin. Moreover, we also found that, surprisingly, said compound, to the contrary of vanillin or ethyl vanillin, is stable, and does not color, in the aggressive medium where vanillin or ethyl vanillin are known to be unstable and provoke undesired strong coloration (for instance medium such as alcoholic compositions, soaps, shampoos or all purpose cleaners).

So 2-methoxy-4-methyl-phenyl methyl carbonate is very interesting as a stable, non coloring, substitute for vanillin or ethyl vanillin In that context, it is interesting to note than the invention's compound is much more vanilla-fragrance like, while having a much less pronounced flavor-like impact in the overall fragrance than the other prior art compounds known as possible substitutes for vanillin (e.g. if compared with 3-hydroxy-2-methyl-4(4h)-pyranone or 2-ethyl-3-hydroxy-4(4h)-pyranone), or also much more powerful (e.g. if compared with, 4-dimethoxybenzaldehyde).

As other specific, but non-limiting, examples of the invention's compounds, one may cite the following ones in Table 1:

TABLE 1

Invention's compounds and their odor properties

| Compound structure and name | Odor notes |
|---|---|
| 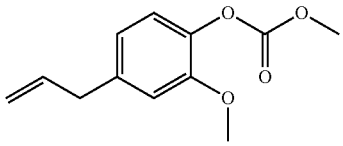 4-allyl-2-methoxy-phenyl methyl carbonate | A surprising combination of white flower notes and spicy, nutmeg, ginger notes |

TABLE 1-continued

| Invention's compounds and their odor properties | |
|---|---|
| Compound structure and name | Odor notes |
| 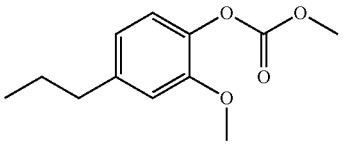 2-methoxy-4-propyl-phenyl methyl carbonate | Spicy, clove note |
| 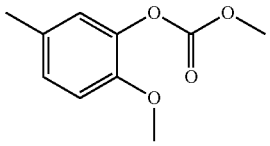 2-methoxy-5-methyl-phenyl methyl carbonate | Spicy, guaiacol note |
| 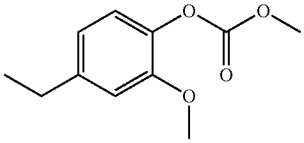 2-methoxy-4-ethyl-phenyl methyl carbonate | Vanilla-balsamic, slightly guiacol notes |
| 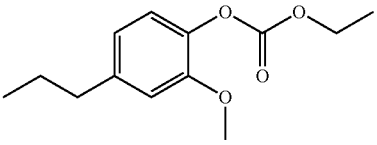 2-methoxy-4-propyl-phenyl ethyl carbonate | Spicy odor |

According to a particular embodiment of the invention, the compounds of formula (I) are 2-methoxy-4-methyl-phenyl methyl carbonate or 4-allyl-2-methoxy-phenyl methyl carbonate.

The olfactory properties of the invention's compounds are all the more interesting considering that the invention's compounds having a vanilla note are very surprising since, to the best of our knowledge, the prior art compounds known to have a vanilla note or used as replacer of vanillin have all a chemical structure significantly different from the one of the present invention.

As mentioned above, the invention concerns the use of a compound of formula (I) as perfuming ingredient. In other words, it concerns a method to confer, enhance, improve or modify the odor properties of a perfuming composition or of a perfumed article, which method comprises adding to said composition or article an effective amount of at least a compound of formula (I). By "use of a compound of formula (I)" it has to be understood here also the use of any composition containing a compound (I) and which can be advantageously employed in perfumery industry.

Said compositions, which in fact can be advantageously employed as perfuming ingredients, are also an object of the present invention.

Therefore, another object of the present invention is a perfuming composition comprising:

i) as perfuming ingredient, at least one invention's compound as defined above;

ii) at least one ingredient selected from the group consisting of a perfumery carrier and a perfumery base; and iii) optionally at least one perfumery adjuvant.

By "perfumery carrier" we mean here a material which is practically neutral from a perfumery point of view, i.e. that does not significantly alter the organoleptic properties of perfuming ingredients. Said carrier may be a liquid or a solid.

As liquid carrier one may cite, as non-limiting examples, an emulsifying system, i.e. a solvent and a surfactant system, or a solvent commonly used in perfumery. A detailed description of the nature and type of solvents commonly used in perfumery cannot be exhaustive. However, one can cite as non-limiting example solvents such as dipropyleneglycol, diethyl phthalate, isopropyl myristate, benzyl benzoate, 2-(2-ethoxyethoxy)-1-ethanol or ethyl citrate, which are the most commonly used. For the compositions which comprise both a perfumery carrier and a perfumery base, other suitable perfumery carriers, than those previously specified, can be also ethanol, water/ethanol mixtures, limonene or other terpenes, isoparaffins such as those known under the trademark Isopar® (origin: Exxon Chemical) or glycol ethers and glycol ether esters such as those known under the trademark Dowanol® (origin: Dow Chemical Company).

As solid carrier one may cite, as non-limiting examples, absorbing gums or polymers, or yet encapsulating materials. Examples of such materials may comprise wall-forming and plasticizing materials, such as mono, di- or trisaccharides, natural or modified starches, hydrocolloids, cellulose derivatives, polyvinyl acetates, polyvinylalcohols, proteins or pectins, or yet the materials cited in reference texts such as H. Scherz, Hydrokolloids: Stabilisatoren, Dickungs- and Gehermittel in Lebensmittel, Band 2 der Schriftenreihe Lebensmittelchemie, Lebensmittelqualitat, Behr's VerlagGmbH & Co., Hamburg, 1996. The encapsulation is a well known process to a person skilled in the art, and may be performed, for instance, using techniques such as spray-drying, agglomeration or yet extrusion; or consists of a coating encapsulation, including coacervation and complex coacervation techniques.

By "perfumery base" we mean here a composition comprising at least one perfuming co-ingredient.

Said perfuming co-ingredient is not of formula (I). Moreover, by "perfuming co-ingredient" it is meant here a compound which is used in a perfuming preparation or a composition to impart a hedonic effect. In other words such a co-ingredient, to be considered as being a perfuming one, must be recognized by a person skilled in the art as being able to impart or modify in a positive or pleasant way the odor of a composition, and not just as having an odor.

The nature and type of the perfuming co-ingredients present in the base do not warrant a more detailed description here, which in any case would not be exhaustive, the skilled person being able to select them on the basis of his general knowledge and according to intended use or application and the desired organoleptic effect. In general terms, these perfuming co-ingredients belong to chemical classes as varied as alcohols, lactones, aldehydes, ketones, esters, ethers, acetates, nitriles, terpenoids, nitrogenous or sulphurous heterocyclic compounds and essential oils, and said perfuming co-ingredients can be of natural or synthetic origin. Many of these co-ingredients are in any case listed in reference texts such as the book by S. Arctander, Perfume and Flavor Chemicals, 1969, Montclair, N.J., USA, or its more recent versions, or in other works of a similar nature, as well as in the abundant patent literature in the field of perfumery. It is also understood that said co-ingredients may also be compounds known to release in a controlled manner various types of perfuming compounds.

By "perfumery adjuvant" we mean here an ingredient capable of imparting additional added benefit such as a color, a particular light resistance, chemical stability, etc. A detailed description of the nature and type of adjuvant commonly used in perfuming bases cannot be exhaustive, but it has to be mentioned that said ingredients are well known to a person skilled in the art.

An invention's composition consisting of at least one compound of formula (I) and at least one perfumery carrier represents a particular embodiment of the invention as well as a perfuming composition comprising at least one compound of formula (I), at least one perfumery carrier, at least one perfumery base, and optionally at least one perfumery adjuvant.

It is useful to mention here that the possibility to have, in the compositions mentioned above, more than one compound of formula (I) is important as it enables the perfumer to prepare accords, perfumes, possessing the odor tonality of various compounds of the invention, creating thus new tools for his work.

For the sake of clarity, it is also understood that any mixture resulting directly from a chemical synthesis, e.g. a reaction medium without an adequate purification, in which the compound of the invention would be involved as a starting, intermediate or end-product could not be considered as a perfuming composition according to the invention as far as said mixture does not provide the inventive compound in a suitable form for perfumery. Thus, unpurified reaction mixtures are generally excluded from the present invention unless otherwise specified.

Furthermore, the invention's compound can also be advantageously used in all the fields of modern perfumery, i.e. fine or functional perfumery, to positively impart or modify the odor of a consumer product into which said compound (I) is added. Consequently, a perfuming consumer product which comprises:

i) as perfuming ingredient, at least one compound of formula (I), as defined above; and ii) a perfumery consumer base;

is also an object of the present invention.

The invention's compound can be added as such or as part of an invention's perfuming composition.

For the sake of clarity, it has to be mentioned that, by "perfuming consumer product" it is meant a consumer product which is expected to deliver at least a perfuming effect, in other words it is a perfumed consumer product. For the sake of clarity, it has to be mentioned that, by "perfumery consumer base" we mean here the functional formulation, as well as optionally additional benefit agents, corresponding to a consumer product which is compatible with perfuming ingredients and is expected to deliver a pleasant odor to the surface to which it is applied (e.g. skin, hair, textile, or home surface). In other words, a perfuming consumer product according to the invention comprises the functional formulation, as well as optionally additional benefit agents, corresponding to the desired consumer product, e.g. a detergent or an air freshener, and an olfactive effective amount of at least one invention's compound.

The nature and type of the constituents of the perfumery consumer base do not warrant a more detailed description here, which in any case would not be exhaustive, the skilled person being able to select them on the basis of his general knowledge and according to the nature and the desired effect of said product.

Non-limiting examples of suitable perfumery consumer base can be a perfume, such as a fine perfume, a cologne or an after-shave lotion; a fabric care product, such as a liquid or solid detergent, a fabric softener, a fabric refresher, an ironing water, a paper, or a bleach; a body-care product, such as a hair care product (e.g. a shampoo, a coloring preparation or a hair spray), a cosmetic preparation (e.g. a vanishing cream or a deodorant or antiperspirant), or a skin-care product (e.g. a perfumed soap, shower or bath mousse, oil or gel, or a hygiene product); an air care product, such as an air freshener or a "ready to use" powdered air freshener; or a home care product, such as a wipe, a dish detergent or hard-surface detergent.

Some of the above-mentioned consumer product bases may represent an aggressive medium for the invention's compound, so that it may be necessary to protect the latter from premature decomposition, for example by encapsulation or by chemically bounding it to another chemical which is suitable to release the invention's ingredient upon a suitable external stimulus, such as an enzyme, light, heat or a change of pH.

The proportions in which the compounds according to the invention can be incorporated into the various aforementioned articles or compositions vary within a wide range of values. These values are dependent on the nature of the article to be perfumed and on the desired organoleptic effect as well as the nature of the co-ingredients in a given base when the compounds according to the invention are mixed with perfuming co-ingredients, solvents or additives commonly used in the art.

For example, in the case of perfuming compositions, typical concentrations are in the order of 0.01% to 15% by weight, or even more, of the compounds of the invention based on the weight of the composition into which they are incorporated. Concentrations lower than these, such as in the order of 0.001% to 7% by weight, can be used when these compounds are incorporated into perfumed articles, percentage being relative to the weight of the article.

The invention's compounds can be prepared according to a method comprising the a reaction between a suitable phenol ($(R^3)_2(OR^2)C_6H_2OH$) and a suitable mono alkyl carbonate derivative, for example of formula $ClCOOR^1$.

Specific examples of such method are provided in the Examples herein below.

EXAMPLES

The invention will now be described in further detail by way of the following examples, wherein the abbreviations have the usual meaning in the art, the temperatures are indicated in degrees centigrade (° C.); the NMR spectral data were recorded in $CDCl_3$ (if not stated otherwise) with a 360 or 400 MHz machine for $^1H$ and $^{13}C$, the chemical shifts δ are indicated in ppm with respect to TMS as standard, the coupling constants J are expressed in Hz.

Example 1

Synthesis of Compounds of Formula (I)

A) Preparation of 2-methoxy-4-methyl-phenyl methyl carbonate 2-methoxy-4-methylphenol (250 mmol) was dissolved in dry dichoromethane (500 ml) with pyridine (392 mmol) and DMAP (N,N-dimethyl-4-aminopyridine, 4.26 mmol). Methyl chloroformate (317 mmol) was added slowly to this solution and the reaction was stirred at room temperature for 3 hours. The reaction mixture was then poured onto a 2M HCl solution (120 ml), and the aqueous layer was extracted twice with dichloromethane (50 ml). Then the combined organic layers were washed twice with water (100 ml), dried over MgSO4 and filtered. The solvent was evaporated and the residue distilled under reduced pressure (120-140° C., 0.4 mbar) to give 38 g (186 mmol, 74% yield) of pure 2-methoxy-4-methyl-phenyl methyl carbonate.

$^{1}$H-NMR: 2.33 (s, 3H); 3.81 (s, 3H); 3.87 (s, 3H); 6.72 (d, J=7.71; 1H); 6.77 (s, 1H); 6.98 (d, J=8.22 Hz; 1H).

$^{13}$C NMR: 21.4 (q), 55.4 (q), 55.8 (q), 113.4 (d), 121.0 (d), 121.9 (d), 137.2 (s), 137.9 (s), 150.8 (s), 154.2 (s).

B) Preparation of 4-allyl-2-methoxy-phenyl methyl carbonate

Following the same procedure as described under A), starting from eugenol (45 mmol) was obtained 4-allyl-2-methoxyphenyl methyl carbonate (18 mmol, 40% yield).

$^{1}$H-NMR: 3.37 (d, J=6.62 Hz; 2H); 3.83 (s, 3H); 3.88 (s, 3H); 5.07-5.12 (m, 2H); 5.80-6.0 (m, 1H); 6.01 (d, J=8.02; 1H); 6.79 (s, 1H); 7.03 (d, J=7.52; 1H).

$^{13}$C NMR: 40.1 (t), 55.5 (q), 55.9 (q), 112.8 (d), 116.2 (t), 120.6 (d), 122.1 (d), 137.0 (d), 138.4 (s), 139.3 (s), 150.9 (s), 154.1 (s).

C) Preparation of 2-methoxy-4-propyl-phenyl methyl carbonate

Following the same procedure as described under A), starting from dihydroeugenol (20 mmol) was obtained 2-methoxy-4-propyl-phenyl methyl carbonate (8 mmol, 40% yield).

$^{1}$H-NMR: 0.94 (t, J=7.3, 3H); 1.58-1.69 (m, 2H); 2.56 (t, J=7.7, 3H); 3.83 (s, 3H); 3.88 (s, 3H); 6.73 (d, J=4.21; 1H); 6.78 (s, 1H); 7.0 (d, J=4.17; 1H).

$^{13}$C NMR: 13.8 (q), 24.5 (t), 38.0 (t), 55.4 (q), 55.9 (q), 112.8 (d), 120.5 (d), 121.9 (d), 138.1 (s), 142.0 (s), 150.8 (s), 154.2 (s).

D) Preparation of 2-methoxy-5-methyl-phenyl methyl carbonate

Following the same procedure as described under A), starting from 2-methoxy-5-methylphenol (72 mmol) was obtained 2-methoxy-5-methylyl-phenyl methyl carbonate (50 mmol, 69% yield).

$^{1}$H-NMR: 2.27 (s, 3H); 3.80 (s, 3H); 3.87 (s, 3H); 6.85 (d, J=8.31; 1H); 6.93 (s, 1H); 6.98 (d, J=8.16; 1H).

$^{13}$C NMR: 20.4 (q), 55.4 (q), 56.0 (q), 112.5 (d), 123.0 (d), 127.4 (d), 130.5 (s), 139.8 (s), 149.0 (s), 154.1 (s).

E) Preparation of 2-methoxy-4-ethyl-phenyl methyl carbonate

Following the same procedure as described under A), starting from 4-ethyl-2-methoxy-phenol (72 mmol) was obtained 2-methoxy-4-ethyl-phenyl methyl carbonate (45 mmol, 63% yield).

$^{1}$H-NMR: 1.23 (t, J=7.6, 3H); 2.60-2.65 (m, 2H); 3.82 (s, 3H); 3.87 (s, 3H); 6.75 (d, J=4.25; 1H); 6.80 (s, 1H); 7.0 (d, J=4.0; 1H).

$^{13}$C NMR: 15.5 (q), 28.8 (t), 55.4 (q), 55.8 (q), 112.3 (d), 119.8 (d), 122.0 (d), 138.1 (s), 143.5 (s), 150.8 (s), 154.2 (s).

F) Preparation of 2-methoxy-4-propyl-phenyl ethyl carbonate

Following the same procedure as described under A), starting from dihydroeugenol (75 mmol) was obtained 2-methoxy-4-propyl-phenyl ethyl carbonate (66 mmol, 87% yield).

$^{1}$H-NMR: 0.94 (t, J=7, 3H); 1.36 (t, J=7; 3H); 1.58-1.69 (m, 2H); 2.56 (t, J=8; 3H); 3.84 (s, 3H); 4.29 (q, J=7; 2H); 6.73 (dd, J=8.2; 1H); 6.77 (d, J=2; 1H); 7.01 (d, J=8; 1H).

$^{13}$C NMR: 13.8 (q); 14.2 (q); 24.6 (t); 38.0 (t); 55.8 (q); 64.8 (t); 112.8 (d); 120.4 (d); 121.9 (d); 138.1 (s); 141.9 (s); 150.8 (s); 153.5 (s).

Example 2

Preparation of a Perfuming Composition

A perfume for woman, of the oriental type, was prepared by admixing the following ingredients:

| Ingredient | Parts by weight |
|---|---|
| Isoeugenol acetate | 100 |
| Styrallyl acetate | 300 |
| Anisic aldehyde | 150 |
| Benzoic aldehyde | 50 |
| Methyl anthranilate | 50 |
| Ethyl 2-methyl-pentanoate | 50 |
| 1,4-Dioxa-5,17-cycloheptadecanedione | 900 |
| 10%* Maltol | 100 |
| Coumarine | 50 |
| Eugenol | 100 |
| Florol ®[1)] | 200 |
| Geraniol | 200 |
| Hedione ®[2)] | 3200 |
| 3-(1,3-Benzodioxol-5-yl)-2-methylpropanal[3)] | 100 |
| 1,3-Benzodioxole-5-carbaldehyde[3)] | 300 |
| Iralia ®[4)] | 300 |
| Iso E Super ®[5)] | 700 |
| Isojasmone | 50 |
| Kephalis[6)] | 300 |
| 10%* Liffarome[7)] | 50 |
| Mandarin essential oil | 400 |
| 6,6-Dimethoxy-2,5,5-trimethyl-2-hexene | 300 |
| Methyl naphthyl ketone | 100 |
| Muscenone ®[8)] Delta | 200 |
| Patchouli essential oil | 200 |
| Cis-3-hexenol salicylate | 300 |
| 10%* 2,4-Dimethyl-3-cyclohexene-1-carbaldehyde | 250 |
| | 9000 |

*in dipropyleneglycol

[1)]tetrahydro-2-isobutyl-4-methyl-4(2H)-pyranol; origin: Firmenich SA, Geneva, Switzerland

[2)]methyl cis-dihydrojasmonate; origin: Firmenich SA, Geneva, Switzerland

[3)]origin: Firmenich SA, Geneva, Switzerland

[4)]mixture of methylionones isomers; origin: Firmenich SA, Geneva, Switzerland

[5)]1-(octahydro-2,3,8,8-tetramethyl-2-naphtalenyl)-1-ethanone; origin: International Flavors & Fragrances, USA

[6)]4-(1-ethoxyethenyl)-3,3,5,5-cyclohexan-1-one; origin: Givaudan SA, Vernier, Switzerland

[7)]carbonate de 3-hexenyl-methyl; origin: International Flavors & Fragrances, USA

[8)]3-methyl-5-cyclopentadecen-1-one; origin: Firmenich SA, Geneva, Switzerland

The addition of 1000 parts by weight of 2-methoxy-4-methyl-phenyl methyl carbonate to the above-described composition imparted to this fragrance a natural vanilla sweetness characteristic of vanillin, but without conferring coloration as did the addition of vanillin When instead of the invention's compound was added the same amount of 3-hydroxy-2-methyl-4(4h)-pyranone or 2-ethyl-3-hydroxy-4(4h)-pyranone, two known and widely used substitutes for vanillin, then the fragrance did not acquire a coloration but the olfactive effect was significantly different from the one of vanillin in the sense that the fragrance acquired a flavor-like and chocolate connotation, an effect not observed with the invention's compound.

When instead of the invention's compound was added the same amount of 4-dimethoxybenzaldehyde, another known and widely used substitute for vanillin, then the fragrance did not acquire a coloration but the olfactive effect was much weaker (10 times weaker) than the one obtained with the invention's compound.

Example 3

Preparation of a perfuming composition

A perfuming composition for soap, of the oriental type, was prepared by admixing the following ingredients:

| Ingredient | Parts by weight |
|---|---|
| Benzyl acetate | 200 |
| Gaiol acetate | 100 |
| Styrallyl acetate | 10 |
| Amylcinnamic aldehyde | 220 |
| 10%* C 11 lenique aldehyde | 20 |
| C 12 aldehyde | 10 |
| 10%* Wormwood essential oil | 150 |
| Cashmeran ®[1)] | 10 |
| Cedar essential oil | 10 |
| Citronellol | 10 |
| Coumarine | 50 |
| Doremox ®[2)] | 10 |
| Eugenol | 100 |
| Geraniol | 40 |
| Geranium essential oil | 20 |
| Hedione ®[3)] | 140 |
| Lilial ®[4)] | 160 |
| Linalool | 20 |
| Lorysia ®[5)] | 200 |
| Lyral ®[6)] | 100 |
| 10%* Crystal moss essential oil | 40 |
| Muscenone ®[7)] Delta | 20 |
| Nirvanol ®[8)] | 20 |
| 10%* Gamma nonalactone | 10 |
| 10%* Patchouli essential oil | 50 |
| Phenethylol | 300 |
| 10%* 4-Methylphenyl phenylacetate | 40 |
| Benzyl propionate | 10 |
| Amyl salicylate | 200 |
| Benzyl 2-hydroxybenzoate | 250 |
| Sclareolate ®[9)] | 20 |
| Terpineol | 10 |
| Gamma undecalactone | 20 |
| (2,2-Dimethoxyethyl)benzene | 20 |
| Vertofix ®[10)] Coeur | 340 |
| Ylang essential oil | 20 |
| | 2950 |

*in dipropyleneglycol

[1)]1,2,3,5,6,7-hexahydro-1,1,2,3,3-pentamethyl-4-indenone; origin: International Flavors & Fragrances, USA

[2)]tetrahydro-4-methyl-2-phenyl-2H-pyran; origin: Firmenich SA, Geneva, Switzerland

[3)]methyl cis-dihydrojasmonate; origin: Firmenich SA, Geneva, Switzerland

[4)]3-(4-tert-butylphenyl)-2-methylpropanal; origin: Givaudan SA, Vernier, Switzerland

[5)]4-(1,1-dimethylethyl)-1-cyclohexyl acetate; origin: Firmenich SA, Geneva, Switzerland

[6)]4/3-(4-hydroxy-4-methylpentyl)-3-cyclohexene-1-carbaldehyde; origin: International Flavors & Fragrances, USA

[7)]3-methyl-5-cyclopentadecen-1-one; origin: Firmenich SA, Geneva, Switzerland

[8)]3,3-dimethyl-5-(2,2,3-trimethyl-3-cyclopenten-1-yl)-4-penten-2-ol; origin: Firmenich SA, Geneva, Switzerland

[9)]propyl (S)-2-(1,1-dimethylpropoxy)propanoate; origin: Firmenich SA, Geneva, Switzerland

[10)]Methyl cedryl ketone; origin: International Flavors & Fragrances, USA

The addition of 50 parts by weight of 2-methoxy-4-methyl-phenyl methyl carbonate to the above-described composition imparted to the latter vanilla-like sweetness similar to the one imparted by vanillin A soap comprising the above composition and the invention's compound did not color, while a soap comprising the above composition and vanillin became totally brown within 3 days.

What is claimed is:

1. A method to confer, enhance, improve or modify the odor properties of a perfuming composition or of a perfumed article, which method comprises adding to said composition or article an effective amount of at least a compound of formula (I) to provide sweet vanillin (balsamic) type odor notes, wherein formula (I) is (I)

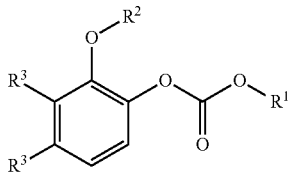

wherein $R^l$ represents a $C_{1-3}$ hydrocarbon group;

$R^2$ represents a $C_{1-3}$ hydrocarbon group; and one $R^3$ represents a $C_{1-3}$ hydrocarbon group, and the other $R^3$ represents a hydrogen atom.

2. The method according to claim 1, wherein said compound is of formula (II)

(II)

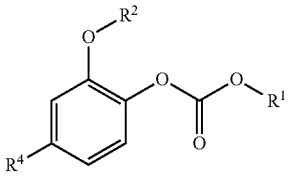

wherein $R^l$ represents a $C_{1-3}$ hydrocarbon group;

$R^2$ represents a $C_{1-3}$ hydrocarbon group; and $R^4$ represents a $C_{1-3}$ hydrocarbon group.

3. The method according to claim 1, wherein said compound is a $C_{10}$-$C_{12}$ compound.

4. The method according to claim 1, wherein said compound is 2-methoxy-4-methyl-phenyl methyl carbonate or 4-allyl-2-methoxy-phenyl methyl carbonate.

5. The method according to claim 1, wherein said compound is used to confer, enhance, improve or modify spicy and/or balsamic odor notes of a perfuming composition or of a perfumed article.

6. A perfuming composition comprising:

i) as perfuming ingredient, at least one compound of formula (I) in an amount sufficient to provide sweet vanillin (balsamic) type odor notes, wherein formula (I) is (I)

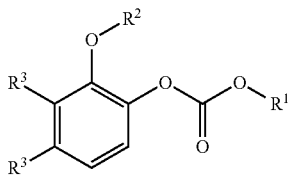

wherein $R^1$ represents a $C_{1-3}$ hydrocarbon group;

$R^2$ represents a $C_{1-3}$ hydrocarbon group; and one $R^3$ represents a $C_{1-3}$ hydrocarbon group, and the other $R^3$ represents a hydrogen atom;

ii) at least one ingredient selected from the group consisting of a perfumery carrier and a perfumery base; and iii) optionally at least one perfumery adjuvant.

7. A perfuming consumer product comprising:

i) at least one compound of formula (I) in an amount sufficient to provide sweet vanillin (balsamic) type odor notes, wherein formula (I) is (I)

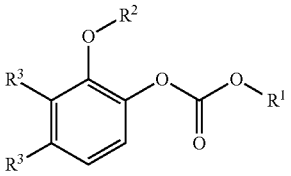

wherein $R^1$ represents a $C_{1-3}$ hydrocarbon group;

$R^2$ represents a $C_{1-3}$ hydrocarbon group; and one $R^3$ represents a $C_{1-3}$ hydrocarbon group, and the other $R^3$ represents a hydrogen atom; and ii) a perfumery consumer base.

8. The perfuming consumer product according to claim 7, wherein the perfumery consumer base is a perfume, a fabric care product, a body-care product, an air care product or a home care product.

9. The perfuming consumer product according to claim 7, wherein the perfumery consumer base is a fine perfume, a cologne, an after-shave lotion, a liquid or solid detergent, a fabric softener, a fabric refresher, an ironing water, a paper, a bleach, a shampoo, a coloring preparation, a hair spray, a vanishing cream, a deodorant or antiperspirant, a perfumed soap, shower or bath mousse, oil or gel, a hygiene product, an air freshener, a "ready to use" powdered air freshener, a wipe, a dish detergent or hard-surface detergent.

* * * * *